US008025013B2

(12) United States Patent
Delucia et al.

(10) Patent No.: US 8,025,013 B2
(45) Date of Patent: Sep. 27, 2011

(54) MOVING PLATFORM ON RAIL VEHICLE

(75) Inventors: Anthony P. Delucia, Gatson, SC (US); Robert S. Miller, Columbia, SC (US)

(73) Assignee: Harsco Technologies Corporation, Fairmont, MN (US)

( * ) Notice: Subject to any disclaimer, the term of this patent is extended or adjusted under 35 U.S.C. 154(b) by 374 days.

(21) Appl. No.: 12/263,654

(22) Filed: Nov. 3, 2008

(65) Prior Publication Data

US 2011/0120342 A1 May 26, 2011

Related U.S. Application Data

(60) Provisional application No. 61/001,413, filed on Nov. 1, 2007.

(51) Int. Cl.
*E01B 27/00* (2006.01)
*B62D 33/063* (2006.01)

(52) U.S. Cl. ..... 104/2; 104/10; 180/89.13

(58) Field of Classification Search ..... 104/2, 10; 180/89.13

See application file for complete search history.

(56) References Cited

U.S. PATENT DOCUMENTS 4,627,358 A * 12/1986 Theurer ..... 104/7.2
4,646,645 A * 3/1987 Theurer ..... 104/7.2
4,928,599 A * 5/1990 Hansmann et al. ..... 104/12
2004/0144282 A1* 7/2004 Huwer ..... 104/2

* cited by examiner

*Primary Examiner* — Joe Morano, IV
*Assistant Examiner* — Zachary Kuhfuss
(74) *Attorney, Agent, or Firm* — McNees Wallace & Nurick LLC

(57) ABSTRACT

A rail vehicle having a single frame assembly and a movable platform coupled thereto is provided. The rail vehicle indexes, i.e. advances intermittently, along railroad rails. The movable platform advances in a single direction at a generally steady speed as the rail vehicle indexes along a railroad. The platform is the floor of, or a base for, a cabin preferably having a seat, roof support, and controls for the operator. The platform rides longitudinally with the machine on rollers or slides, thus separating the operator and controls from the rest of the machine. Thus, while the rail vehicle moves in an abrupt stop-and-go manner, the platform and the operator move generally consistently in a single direction.

19 Claims, 3 Drawing Sheets

MOVING PLATFORM ON RAIL VEHICLE

CROSS REFERENCE TO RELATED APPLICATION

This application claims priority under 35 U.S.C. §119(e) to U.S. Provisional Patent Application Ser. No. 61/001,413, filed Nov. 1, 2007 entitled, Continuous moving platform on rail vehicle.

FIELD OF THE INVENTION

This application relates to railroad maintenance vehicles and, more specifically to a railroad maintenance vehicle having a platform that moves generally continuously at one speed and in one direction while the rail vehicle repeatedly starts and stops at short intervals.

BACKGROUND INFORMATION

Generally, a railroad includes at least one pair of elongated, substantially parallel rails coupled to a plurality of laterally extending ties and which are disposed on a ballast bed. The rails are coupled to the ties by metal tie plates and/or spring clips. The ballast is a hard particulate material such as, but not limited to, gravel. Ties may be made from either concrete or wood. The ballast filled space between ties is called a crib. Concrete ties are typically spaced about twenty-four inches apart, whereas wood ties are spaced about nineteen and a half inches apart.

During installation and maintenance various operations must be performed at each tie location. For example, ballast must be "tamped," or compressed, to ensure that the ties, and therefore the rails, do not shift. A tamping device, not surprisingly called a "tamper," typically consists of at least two pairs of work heads mounted on a motorized vehicle structured to travel on the rails. A work head includes a pair of elongated, vertically extending tools structured to move together in a pincer-like motion as well as being structured to move vertically. The tools, preferably, have two prongs spaced so that each prong may be disposed on opposite lateral sides of a rail. The work head further includes a vibration device structured to rapidly vibrate the tools. In this configuration, a work head may be disposed above a tie with one tool on either side of the tie. Further, the prongs of each tool are disposed on either sides of the rail. Thus, a tool prong is disposed above, and just outside, of each corner of the rail/tie interface. At least two work heads are used so that one work head may be placed over each rail.

Initially, the tools are generally vertical and parallel to each other. When actuated, the tool head moves vertically downward so that the tips of the tools, that is the tips of the prongs, are inserted into the ballast to a predetermined depth that is, preferably, below the bottom of the tie. The tools are then brought together in a pincer-like motion thereby compressing the ballast under the tie. Actuation of the vibration assembly further compresses the ballast under the tie. Once the vibration operation is complete, the tools are returned to a substantially vertical orientation and lifted out of the ballast. The tamper then advances to the next tie and the operation is repeated. Typically, a tamping operation lasts about three seconds.

The act of advancing the tamper to the next work location may be called "indexing." Indexing may be performed one tie at a time, or multiple ties at a time. For example, some tamping machines include a set of tamping tools at the front end of the rail vehicle and another set of tamping tools at the back end of the vehicle. After identifying a tie at the work site as the first tie, the front set of tamping tools may work upon the "odd" ties and the back set of tamping tools may work upon the "even" ties. In this situation, the tamper vehicle would index, i.e. move forward, two ties at a time. The tamper vehicle, as well as other rail installation and maintenance vehicles, typically locates the tie/rail interface by locating the tie plate that connects the rail to the tie, e.g. by utilizing a metal detector that travels beside the rail.

On conventional indexing machinery, such as, but not limited to tampers, the equipment starts and stops at different intervals as required by the work that has to be performed. In most railroad applications, the indexing motion of different machines is dictated by the tie spacing. Most of the work required on the track is usually performed at each tie location, i.e., tamping of the ballast supporting the ties, lifting and lining of the track panel, spiking of the tie plates for fastening the ties to the rail, anchor removal and/or application, plugging of spike holes, clip application and removal, etc.

Conventional equipment performing track maintenance consists mostly of machines carrying one or two operators. These machines accelerate (under their own power), to the ties requiring work. As they approach the tie, they rapidly slow down to a stop, perform the required work and index to the next tie to repeat the cycle. This work is performed sometimes at a cycle rate of less than three seconds. During this acceleration and deceleration, the operator is being pushed backward and forward by the dynamics of the machine he is riding. The operator is working in a very uncomfortable environment, subject to fatigue, stress and difficulty to perform the required duties of his work.

One existing machine designed to alleviate the problem on the operator, consists of splitting the machine in two segments: one half of the machine does the indexing and a first work function while the other half moves at a constant speed while sometimes performing a different work function. The operator sits on the continuous moving portion of the machines. This system is normally employed on large machines and works in a satisfactory manner, however, the system is very expensive and cumbersome. For example, two different machines and two drives are required, the system is not practical for smaller and lighter machines due to the additional weight required to achieve an effective tractive effort, and the system requires sophisticated electronics required to control the motion of the two segments relative to each other. That is, without sophisticated electronics controlling the motion of the two segments, the two segments may collide and damage each other and/or injure an operator.

SUMMARY OF THE INVENTION

At least one embodiment of the disclosed invention provides a rail vehicle having a single frame assembly and a movable platform coupled thereto. The movable platform advances in a single direction at a generally steady speed as the rail vehicle indexes along a railroad. This overcomes the disadvantages of having a bifurcated machine. The platform is the floor of, or a base for, a cabin preferably having a seat, roof support, and controls for the operator. The platform rides longitudinally with the machine on rollers or slides, thus separating the operator and controls from the rest of the machine. A movement device such as, but not limited to, pneumatic or hydraulic cylinders, electric, pneumatic or hydraulic motors or electric linear actuators are structured to move the platform longitudinally with respect to the machine frame assembly. The rail vehicle also has a navigation system equipped with an encoder wheel, or other tracking device, that measures the linear movement of the machine on the track. If an encoder wheel is used, the motion of the vehicle is measured in pulses per revolution. While the encoder wheel is turning in a clockwise motion, (forward), the actuator on the platform retracts proportionally to the number of pulses of the encoder wheel (interpreted by a PLC or computer). When the encoder wheel is not turning, the actuator on the platform moves the platform forward at a speed consistent with the platform prior speed relative to the ground.

In this configuration, the operator remains generally immobile in respect to the machine lurching forward. As the machine keeps moving forward, the platform is pulled backwards in respect of the machine while maintaining a generally consistent forward motion relative to the ground. As the machine is being decelerated to a stop, the rate and number of pulses of the encoder wheel cause the actuator controlling the platform position to push the operator station forward at variable adjustable rates. While the machine is stopped to perform the work, the platform keeps moving forward relative to the ground, generally, at the same speed as before. As the machine starts to index forward, the cycle of the platform is repeated. Thus, in relation to the ground, the platform is continually moving forward at a generally consistent speed. This system substantially eliminates fatigue and stresses on the operator, and it is adaptable to any type of rail vehicle with few modifications of the operator's platform.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "single frame assembly" means that the frame assembly moves as a unit relative to a fixed point and that the front of the frame assembly is at a fixed distance from the back of the frame assembly. That is, while the frame assembly may have two or more parts that are articulated relative to each other, the frame assembly does not have distinct units or segments structured to travel on a pair of rails.

As used herein, "coupled" means a link between two or more elements, whether direct or indirect, so long as a link occurs. Unless otherwise noted, this does not include elements resting on, or supported by, a surface. For example, a seat in an automobile is coupled to the engine via the frame and other components. The seat is not, however, coupled to an adjacent automobile via the ground.

As used herein, "directly coupled" means that two elements are directly in contact with each other.

As used herein, "fixedly coupled" or "fixed" means that two components are coupled so as to move as one while maintaining a constant orientation relative to each other.

Figure 1:
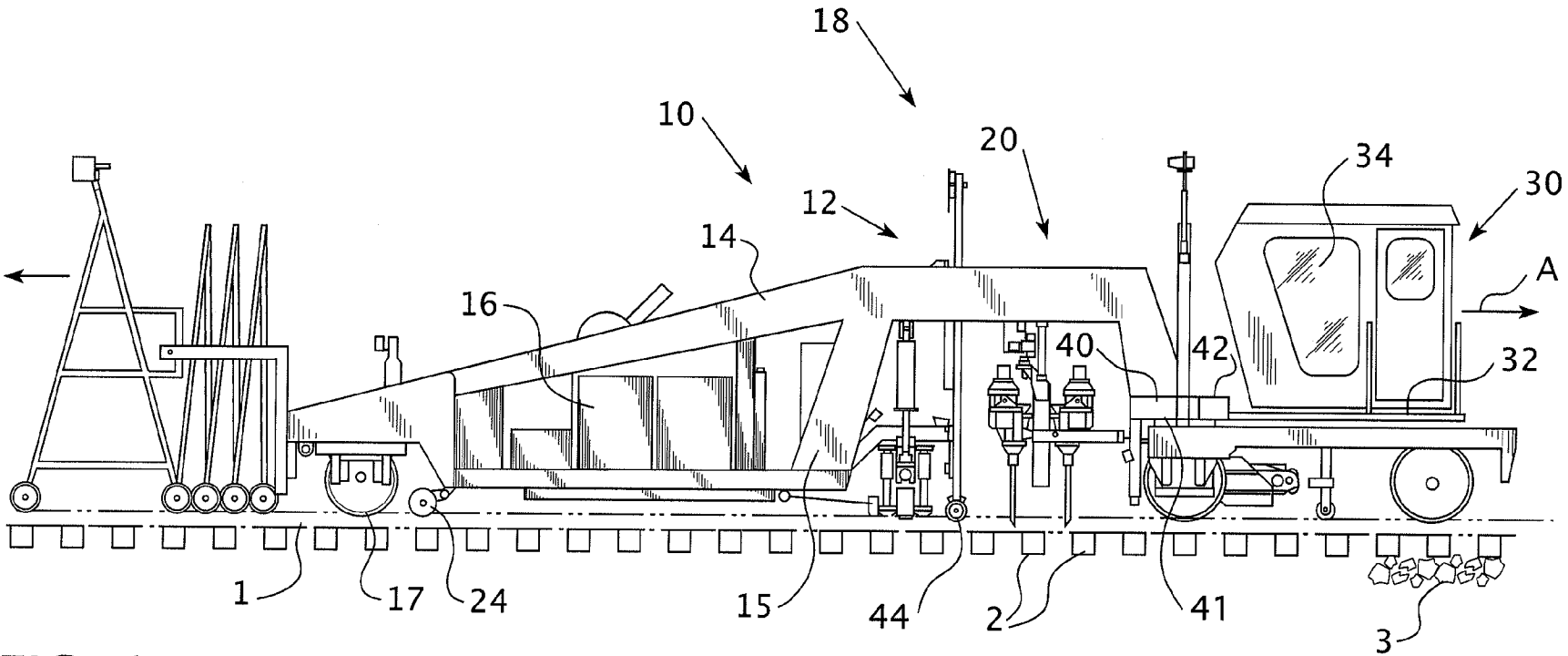
FIG. 1 is a side view of a railroad maintenance vehicle having a movable platform in an aft position relative to the vehicle frame assembly.
Figure 2:
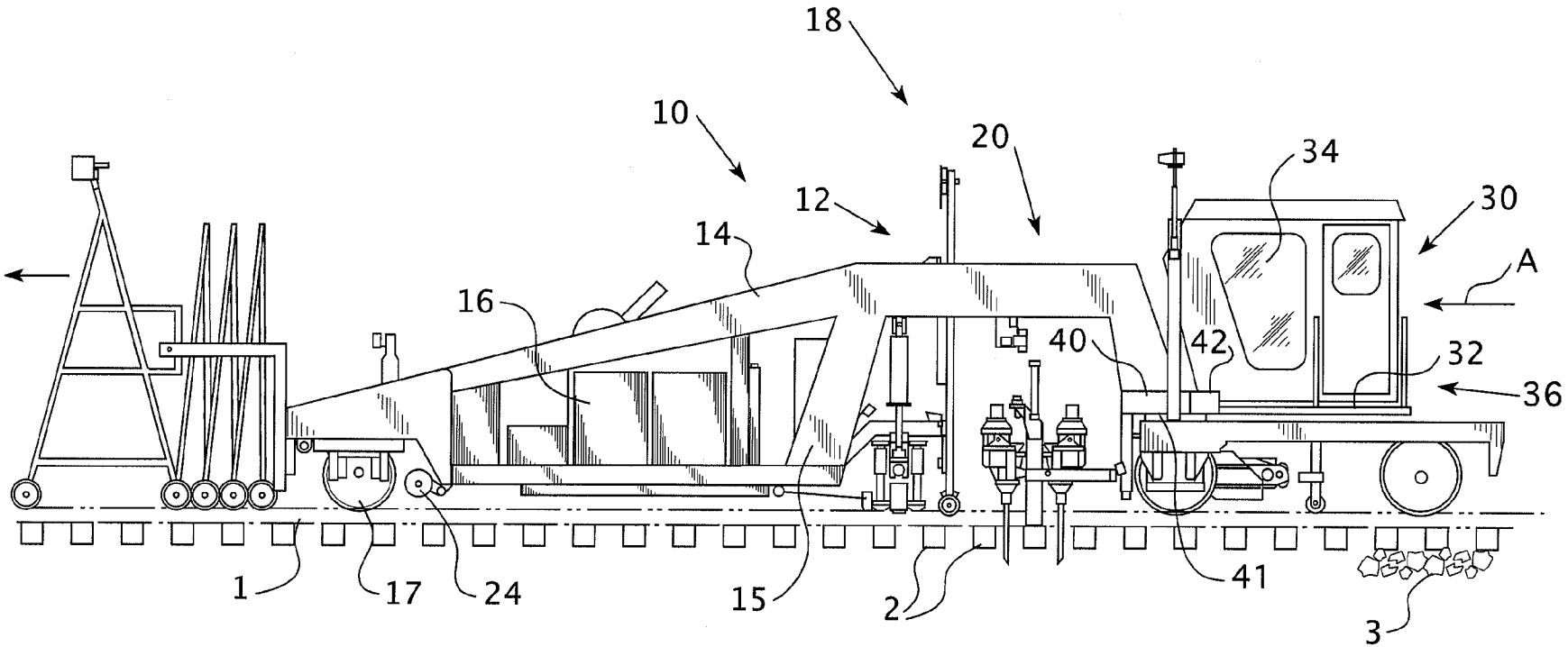
FIG. 2 is a side view of a railroad maintenance vehicle having a movable platform in a medial position relative to the vehicle frame assembly.
Figure 3:
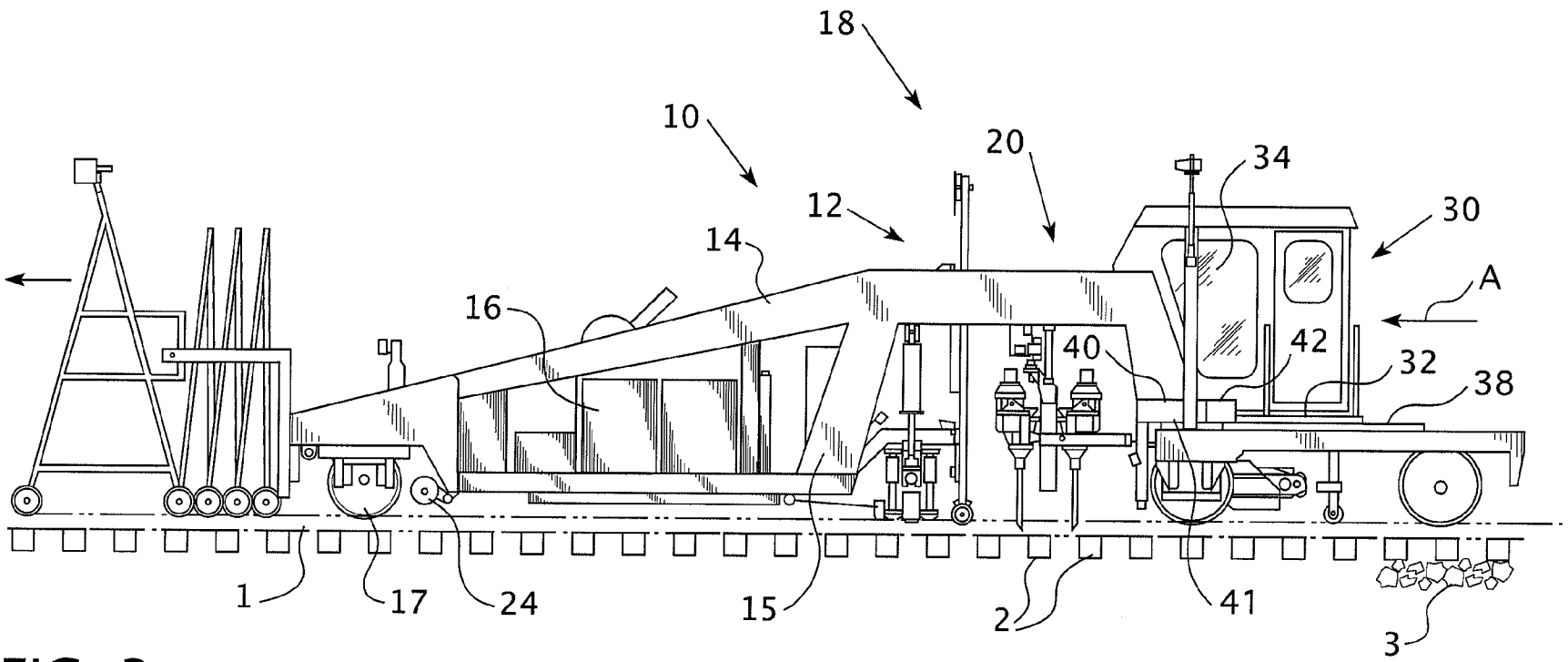
FIG. 3 is a side view of a railroad maintenance vehicle having a movable platform in a forward position relative to the vehicle frame assembly.

A rail vehicle 10, shown as a tamping machine 12, includes a single frame assembly 14, a propulsion device 16 structured to move the rail vehicle 10, an operating device 18, shown as at least one tamping device 20 structured to tamp ties as set forth above, a navigation system 24 and a movable platform assembly 30 having a platform 32 structured to support an operator cabin 34. The platform 32 may be supported in many ways including, but not limited to a cantilever manner, as shown in FIG. 1; the platform 34 may have one or more wheels 36 on the lower side thereof which may, or may not, travel in tracks (not shown), as shown in FIG. 2, and the platform 32 may be supported by one or more rails 38 as shown in FIG. 3.

As is known in the art, the rail vehicle 10 moves over a pair of rails 1 disposed on a series of ties 2 which are further disposed on a bed of ballast 3. The rail vehicle frame assembly 14 includes a plurality of rigid frame members 15 and a plurality of rail wheels 17 structured to travel on the rails 1.

In operation, the rail vehicle 10 stops when the at least one tamping device 20 is disposed over a first tie 2. The at least one tamping device 20 then tamps the first tie 2, as described above. The rail vehicle 10 then advances until the at least one tamping device 20 is disposed over another, second tie 2. The at least one tamping device 20 then tamps the second tie 2. This operation is repeated for each tie 2. As each tamping operation lasts for just a few seconds, the rail vehicle 10 makes a number of starts and stops while moving along the rails 1. Thus, the frame assembly 14 moves with a rapid intermittent motion. Alternate embodiments include two or more tamping devices 20. Where there are two or more tamping devices 20, the rail vehicle 10 may advance over more than one tie 2 for each cycle. For example, if alternating ties 2 are identified as "odd" and "even" numbered ties 2, and if there are two tamping devices 20, the rail vehicle 10 typically advances over two ties 2 so that a first tamping device 20 tamps the "odd" numbered ties 2 and a second tamping device 20 tamps the "even" numbered ties 2.

The navigation system 24 is structured to track the position of the rail vehicle 10 relative to a fixed location, such as, but not limited to, a location on the ground, as well as the position of each tie 2. The navigation system 24 is further structure to control the propulsion device 16 to effect the forward motion of the rail vehicle 10 and to stop the rail vehicle 10 when the at least one tamping device 20 is positioned over the tie 2 to be tamped. That is, the navigation system 24 includes, or communicates with, a tie detection system (not shown) as is known in the art.

The movable platform assembly 30 also includes a movement device 40 structured to move the platform 32 forward and aft relative to the rail vehicle frame assembly 14. More specifically, the movement device 40 includes a control device 42, preferably a programmable device such as, but not limited to, a programmable logic circuit or computer. The movement device 40 has an actuator 41 (shown schematically) which may be, but is not limited to, pneumatic or hydraulic cylinders, electric, pneumatic or hydraulic motors or electric linear actuators. The movement device actuator 41 is coupled to, and structured to move, the platform 32 longitudinally with respect to the frame assembly 14. The movement device 40 is further structured to monitor the position of the platform 32 relative to the rail vehicle frame assembly 14. This may be accomplished in many ways including, but not limited to, monitoring the extension of the pneumatic or hydraulic cylinders, having positioning sensors disposed on the rail vehicle frame assembly 14 and/or platform 32, or having a draw string transducer, aka a string pot, extending between the rail vehicle frame assembly 14 and the platform 32. The "positioning data" is converted to an electronic signal and communicated to the control device 42. The control device 42 is also in electronic communication with the navigation system 24 and structured to receive movement data therefrom, as described below. The control device 42 is structured to actuate the movement device actuator 41 to move the platform 32 forward or aft relative to the rail vehicle frame assembly 14 in response to the movement of the rail vehicle frame assembly 14 relative to a fixed location. More specifically, the control device 42 is structured to maintain the platform 32 moving forward relative to a fixed location at a generally constant speed regardless of the motion of the rail vehicle frame assembly 14.

The navigation system 24 is, preferably, equipped with an encoder wheel 44, or other tracking device, that measures the generally linear movement of the rail vehicle 10 over the rails 1. If an encoder wheel 44 is used, the motion of the rail vehicle 10 is measured in pulses per revolution. That is, the speed (rotation/time) for each revolution of the encoder wheel 44 is tracked. While the rail vehicle frame assembly 14 is moving forward, the encoder wheel 44 is turning in a counterclockwise motion, as shown in the figures. The speed of the rail vehicle frame assembly 14, or "movement data," is determined either constantly (analog) or, more typically, many times each second (digital), and that data is converted to an electronic signal and communicate the signal to the control device 42. Thus, the control device 42 is structured to compare the positioning data from the movement device 40 to the movement data from the navigation system 24 and determine the relative motion of the rail vehicle frame assembly 14 and the platform 32 and to adjust the motion of the platform 32, that is, actuate the movement device actuator 41 to move the platform 32 forward or aft, so that said platform 32 moves forward relative to a fixed location at a generally constant speed.

Again, using a typical tamping operation as an example, the rail vehicle frame assembly 14 will move forward rapidly, stop and perform a tamping operation, then move forward rapidly again until the tamping device 20 is over the next tie 2 to be tamped, stop and perform the tamping operation on the second tie 2. This cycle, move-stop-tamp, is repeated until all ties 2 are tamped. In order for the movement device 40 to provide a constant forward motion to the platform 32, the movable platform assembly 30 must move the platform 32 in different directions relative to the rail vehicle frame assembly 14 depending upon the stage of the cycle.

For the sake of the following discussion, the platform 32 will be described as having a forward position, a medial position, and an aft position. It is understood that these positions are not fixed relative to the vehicle frame assembly 14 but vary depending upon how far the vehicle frame assembly 14 moves during each cycle as described below. It is also understood that the distance between the forward position and the aft position is, typically, not the total amount of travel available to the platform 32. That is, the movement device actuator 41 is able to move the platform 32 further forward or aft than is required for a typical tamping operation.

Further, for the sake of the following discussion, the operation will be described as occurring some time after the first tie 2 has been tamped and the platform 32 is moving forward at a constant speed relative to a fixed point. It is noted that for the first tie 2 to be tamped, the platform 32 may be still relative to the rail vehicle frame assembly 14 or moving forward at a constant speed relative to a fixed point. Further, it is understood that the tamping cycle will be considered to start just as the tamping devices 20 have completed tamping a tie 2 and have withdrawn to the retracted/upper position.

Thus, once the tamping devices 20 have completed tamping a tie 2 and have withdrawn to the retracted/upper position, the rail vehicle frame assembly 14 moves rapidly forward to the next tie 2. At this time, the control device 42 compares the positioning data from the movement device 40 to the movement data from the navigation system 24 and determines the relative motion of the rail vehicle frame assembly 14 and the platform 32. As the control device 42, as part of the movement device 40, is structured to maintain the platform 32 moving forward at a generally constant speed, the control device 42 causes the movement device actuator 41 to move the platform 32 backwards relative to the rail vehicle frame assembly 14. This backwards movement of the platform 32 relative to the rail vehicle frame assembly 14 is not at a constant speed. That is, the vehicle frame assembly 14 may lurch forward and stop. Thus, the control device 42 is structured to initially move the platform 32 backwards relative to the rail vehicle frame assembly 14 at a rapid speed. Then, as the forward motion of the rail vehicle frame assembly 14 slows and stops, the relative motion of the platform 32 to the rail vehicle frame assembly 14 also slows, but does not stop. The platform 32 does not move at the same speed as the rail vehicle frame assembly 14. The platform 32 moves slightly slower in a rearward direction relative to the rail vehicle frame assembly 14, while the rail vehicle frame assembly 14 moves forward relative to a fixed location. Thus, the platform 32 advances slightly in the longitudinal direction of the rails as the rail vehicle frame assembly 14 indexes an entire tie 2, or more, forward. FIG. 1 represents the relative position of the platform 32 relative to the rail vehicle frame assembly 14 at this time. That is, the platform 32 is in the rear position and has just finished a rearward motion as indicated by arrow A.

When the rail vehicle frame assembly 14 stops, i.e. when the tamping devices 20 are disposed over the next tie 2 to be tamped, the control device 42 causes the movement device actuator 41 to move the platform 32 forward relative to the rail vehicle frame assembly 14. This allows the platform 32 to continue to move in the same direction, and at a regular speed, relative to a fixed location on the ground. Further, because the motion of the platform 32 is constant, the operator is not adversely affected by the start-and-stop motion of the rail vehicle frame assembly 14. The platform 32 continues to move forward relative to the rail vehicle frame assembly 14 during the operation of the tamping devices 20. FIG. 2 represents the relative position of the platform 32 relative to the rail vehicle frame assembly 14 at this time. That is, the platform 32 is in the medial position and moving forward as indicated by arrow A.

As the tamping operation is being completed, the platform 32 moves into the forward position, shown in FIG. 3. Once the tamping operation is complete and the tamping devices 20 are withdrawn to the retracted/upper position, the cycle begins again. That is, once the platform 32 is in the forward position, the rail vehicle frame assembly 14 may move forward again. Once the rail vehicle frame assembly 14 begins to move rapidly forward, the control device 42 is structured to move the platform 32 backwards relative to the rail vehicle frame assembly 14 at a rapid speed as described above.

Thus, despite the fact that the rail vehicle frame assembly 14 is moving in a stop-and-go manner, the platform 32 moves forward at a generally constant speed. The relative motion of the platform 32 relative to the rail vehicle frame assembly 14 is accomplished by comparing the positioning data from the movement device 40 to the movement data from the navigation system 24. Further, it can be seen that because the platform 32 moves forward at a generally constant speed and because the ties are not always evenly spaced, the forward, medial, and aft positions of the platform 32 may vary. That is, for example, when two ties 2 are close together, the forward motion of the rail vehicle frame assembly 14 will occur for a shorter period of time and for a shorter distance. Thus, the platform 32 will not move a great distance rearwardly as the vehicle frame assembly 14 moves between these two ties 2. Conversely, if two ties 2 have a greater than normal spacing, the forward motion of the rail vehicle frame assembly 14 will occur for a longer period of time and for a greater distance. Thus, the platform 32 will move a greater distance rearwardly as the vehicle frame assembly 14 moves between these two ties 2.

Generally, the rail vehicle 10 moves forward at a greater speed than the platform 32. Thus, when the rail vehicle frame assembly 14 is moving forward to position the at least one tamping device 20 over a tie 2, the platform 32 is moving backward relative to the rail vehicle frame assembly 14. The platform 32 moves backwards at a speed slower than the rail vehicle frame assembly 14 is moving forward, thus the platform 32 actually moves forward relative to a fixed location. When the rail vehicle frame assembly 14 is stopped to engage the at least one tamping device 20, the platform 32 is moving forward relative to the rail vehicle frame assembly 14. In this configuration, the platform 32 moves forward relative to a fixed location at a generally constant speed. However, while the platform 32 moves forward relative to a fixed location at a generally constant speed, the actual speed of the platform 32 relative to a fixed location may be varied. That is, the tamping operations, or other work, may require more time at one tie 2 location than at a different tie 2 location. Accordingly, the control device 42 is also structured to adapt the speed of the platform 32 based on additional data.

For example, during a tamping operation the platform 32 is moving forward at a first speed. Sensors (not shown) on the at least one tamping device 20 may provide feedback indicating the progress of the tamping operation. The feedback is input into the control device 42. Alternately, the operator may provide the input into the control device 42 indicating that the tamping operation is slow or not complete. If the control device receives input indicating that the tamping operation requires additional time, the control device 42 adjusts the speed, i.e. slows the speed, of the platform 32 accordingly. That is, in this example, the control device 42 slows the forward speed of the platform 32 relative to both the rail vehicle frame assembly 14 and a fixed location. If the tamping operation requires an extended period of time, i.e. more than a typical tamping operation, the control device 42 gently slows the platform 32, and may stop the platform 32 motion, until the tamping operation is completed. Preferably, the control device 42 causes the movement device 40 to stop the platform 32 at a forward location, as described above. Then, when the tamping operation is complete, the control device 42 causes the movement device 40 to move the platform 32 rearwardly as the rail vehicle frame assembly 14 moves forward to the next location. As set forth above, the movement of the platform 32 rearwardly is at a slightly slower speed than the forward movement of the rail vehicle frame assembly 14. The combined effect of these two motions is that the platform 32 starts to move slowly forward relative to a fixed location. Thus, while the platform 32 may stop moving, the change in motion is not abrupt. That is, the platform 32 is structured to not start or stop in an abrupt manner.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the fall breadth of the claims appended and any and all equivalents thereof.

What is claimed is:

1. A rail vehicle structured to travel over a railroad, said rail vehicle comprising:

an elongated single rail vehicle frame assembly having a plurality of rigid members and a plurality of wheels structured to engage a pair of railroad tracks; and a movable platform assembly movably coupled to said frame assembly, said movable platform assembly having a platform, said platform structured to move longitudinally relative to said rail vehicle frame assembly at a generally constant speed relative to a fixed location;

wherein as said vehicle frame assembly moves forward, said platform moves rearwardly at a speed slightly slower than the speed of the rail vehicle frame assembly moving forward.

2. The rail vehicle of claim 1 wherein:

said movable platform assembly includes a movement device having an actuator and a control device;

said movement device actuator structured to move said platform forward and aft relative to said rail vehicle frame assembly; and said control device structured to control said movement device.

3. The rail vehicle of claim 2 wherein said rail vehicle frame assembly moves forward relative to a fixed location in an intermittent manner and wherein:

said control device is structured to actuate said movement device to move said platform forward or aft relative to the rail vehicle frame assembly in response to the movement of the rail vehicle frame assembly relative to a fixed location so that said platform moves forward at a generally constant speed.

4. The rail vehicle of claim 3 wherein said rail vehicle includes a navigation system structured to track the position of the rail vehicle relative to a fixed location and wherein:

said movement device is structured to monitor the position of the platform relative to said rail vehicle frame assembly and to communicate such positioning data to said control device;

said control device structured to receive movement data from said navigation system and to compare the positioning data from the movement device to the movement data from the navigation system and determine the relative motion of the rail vehicle frame assembly and the platform and to adjust the motion of said platform so that said platform moves forward relative to a fixed location at a generally constant speed.

5. The rail vehicle of claim 4 wherein:

said movement device includes an actuator coupled to said platform; and said movement device actuator structured to move said platform longitudinally with respect to the frame assembly.

6. The rail vehicle of claim 5 wherein said movement device actuator is selected from the group consisting of: pneumatic cylinders, hydraulic cylinders, electric motors, pneumatic motors, hydraulic motors, or electric linear actuators.

7. The rail vehicle of claim 5 wherein said platform supports an operator cabin.

8. The rail vehicle of claim 1 wherein said platform supports an operator cabin.

9. A rail vehicle structured to travel over a railroad, said rail vehicle comprising:

a single frame assembly having a plurality of rigid members and a plurality of wheels structured to engage a pair of railroad rails;

a propulsion device coupled to said frame assembly and structured to move said frame assembly over said railroad tracks;

a navigation system structured to control the propulsion device and the motion of the frame assembly;

a moveable platform assembly having a platform movably coupled to said frame assembly; and said movable platform assembly structured to move said platform longitudinally relative to said rail vehicle frame assembly so that as said frame assembly moves forward, said platform moves rearwardly at a speed slightly slower than the speed of the frame assembly moving forward, wherein said platform moves at a generally constant speed relative to a fixed location.

10. The rail vehicle of claim 9 wherein:

said movable platform assembly includes a movement device and a control device;

said movement device structure to move said platform forward and aft relative to said rail vehicle frame assembly; and said control device structured to control said movement device.

11. The rail vehicle of claim 10 wherein said rail vehicle frame assembly moves forward relative to a fixed location in an intermittent manner and wherein:

said control device is structured to actuate said movement device to move said platform forward or aft relative to the rail vehicle frame assembly in response to the movement of the rail vehicle frame assembly relative to a fixed location so that said platform moves forward at a generally constant speed.

12. The rail vehicle of claim 11 wherein:

said movement device is structured to monitor the position of the platform relative to said rail vehicle frame assembly and to communicate such positioning data to said control device;

said navigation system is structured to measure the generally linear movement of said rail vehicle over said rails and to communicate such movement data to said control device;

said control device structure to compare the positioning data from the movement device to the movement data from the navigation system and determine the relative motion of the rail vehicle frame assembly and the platform and to adjust the motion of said platform so that said platform moves forward relative to a fixed location at a generally constant speed.

13. The rail vehicle of claim 12 wherein:

said movement device includes an actuator coupled to said platform; and said movement device actuator structured to move said platform longitudinally with respect to the frame assembly.

14. The rail vehicle of claim 13 wherein said movement device actuator is selected from the group consisting of: pneumatic cylinders, hydraulic cylinders, electric motors; pneumatic motors, hydraulic motors, or electric linear actuators.

15. The rail vehicle of claim 14 wherein said platform supports an operator cabin.

16. The rail vehicle of claim 9 wherein said platform supports an operator cabin.

17. A method of working on a railroad using a rail vehicle structured to intermittently advance along a pair of rails, said rail vehicle having a single frame assembly with a plurality of rigid members and a plurality of wheels structured to engage a pair of railroad tracks, a propulsion device coupled to said frame assembly and structured to move said frame assembly over said railroad rails, a navigation system structured to control the propulsion device and the motion of the frame assembly, a moveable platform assembly movably coupled to said frame assembly, and, said movable platform assembly structured to move relative to said frame assembly, said platform structured to move longitudinally relative to said rail vehicle frame at a generally constant speed relative to a fixed location, said method comprising the steps of:

a) when said vehicle moves forward, moving said platform rearwardly at a speed slightly slower than the speed of the rail vehicle moving forward;

b) when said rail vehicle stops, moving said platform forwardly;

c) repeating steps (a) and (b);

whereby said platform moves at a generally constant speed relative to a fixed location.

18. The method of claim 17 wherein said rail vehicle includes at least one tamping device, said tamping device structure to tamp ballast under railroad ties, and wherein during the step of moving said platform forwardly, said tamping device is actuated to tamp said ballast.

19. The method of claim 18 wherein said movable platform assembly includes a movement device and a control device, said movement device structured to move said platform forward and aft relative to said rail vehicle frame assembly, said control device structured to control said movement device and adapt the speed of the platform based on additional data, and wherein a) during said tamping operation, providing feedback to said control device indicating the tamping operation is slower than a typical tamping operation; and b) slowing the forward motion of said platform.

* * * * *